United States Patent [19]

Tanaka et al.

[11] 4,160,056

[45] Jul. 3, 1979

[54] STEEL SHEET FOR Drd CANS AND DI CANS

[75] Inventors: Tadashi Tanaka, Yokohama; Tatsuro Obi, Tokyo; Nobuichi Arai, Sagamihara; Teruo Koyama, Yokohama, all of Japan

[73] Assignee: Nippon Steel Corporation, Tokyo, Japan

[21] Appl. No.: 834,005

[22] Filed: Sep. 16, 1977

[30] Foreign Application Priority Data

Sep. 20, 1976 [JP] Japan ..... 51-112577

[51] Int. Cl.[2] ..... B65D 65/42; B65D 7/42; B32B 15/08

[52] U.S. Cl. ..... 428/220; 220/1 BC; 220/62; 220/83; 426/126; 426/131; 428/36; 428/416; 428/418; 428/460; 428/461; 428/463

[58] Field of Search ..... 428/461, 35, 36, 457, 428/458, 416, 418, 460, 463, 220, 461; 426/131, 126; 220/62, 64, 1 BC

[56] References Cited

U.S. PATENT DOCUMENTS

| | | | |
|---|---|---|---|
| 2,482,086 | 9/1949 | Foster | 428/461 X |
| 2,699,413 | 1/1955 | Seagren | 428/461 X |
| 3,717,543 | 2/1973 | Sinclair et al. | 428/416 |
| 3,959,567 | 5/1976 | Bradley | 428/461 |
| 3,967,020 | 6/1976 | Uemura et al. | 428/461 X |
| 3,993,841 | 11/1976 | Matsubara et al. | 426/131 X |
| 3,997,694 | 12/1976 | Wu | 428/35 |
| 4,060,657 | 11/1977 | Iwami et al. | 428/460 X |
| 4,107,380 | 8/1978 | Wiesman | 428/463 X |

*Primary Examiner*—Harold Ansher
*Attorney, Agent, or Firm*—Toren, McGeady and Stanger

[57] ABSTRACT

A steel sheet for production of DrD or DI cans, comprising a cold rolled steel sheet, a solvent type thermosetting paint coating containing ethylene-vinyl acetate copolymer baked on the steel sheet in a completely cured state.

2 Claims, No Drawings

STEEL SHEET FOR DrD CANS AND DI CANS

FIELD OF THE INVENTION

The present invention relates to paint-coated steel sheet or strip (hereinafter called simply steel sheet) suitable for production of drawn and redrawn (DrD) cans and drawn and ironed (DI) cans for preserving various foods, beverage such as beer and carbonate beverage.

BACKGROUND OF THE INVENTION AND PRIOR ARTS

As the material for producing various cans, particularly cans for food and beverage preservation, tin-plate has been most commonly used. However, in recent years, the tin source in the world has been in short supply, and the production cost of tin-plate has been increasing. In order to solve the situation, various efforts have been made, including reduction of the coating amount of tin on electrolytic tin-plate, and developments of tin-free steel (T.F.S.) coated with metallic chromium and a chromate film thereon. Further, along with the above efforts, trials and proposals have been made to use a cold rolled steel sheet for the cans for the purposes of lowering the production cost thus saving the material source and energy, and solving the pollution caused by the used cans.

Meanwhile, in the field of the can making techniques, considerable technical progress has been made and it is now possible to produce cans by the drawing and redrawing process or by the drawing and ironing process. In the production of DrD or DI cans, the starting steel sheet material (black plate) is deep-drawn (DrD), further ironing flanged, and coated on both inside and outside surfaces, and then after charging with foods or beverage, the lid is set. According to the above production method, thin two-piece cans having high strength can be obtained, and various advantages are provided, including the labour-saving by automation of the process line and the cost-saving.

However, the above production method requires a high level of formability of the starting material, and thus is limited in its application in respect with formability and corrosion resistance. Therefore, up to now only aluminum and tin-plate have been successfully formed by the above method, and the tin-free steel or cold rolled steel sheet has never been successfully formed into cans by the above method. If a cold rolled steel sheet can be used as the starting material for production of DI cans, this would offer a tremendous advantage and solve the world-wide problem of the tin source.

SUMMARY OF THE INVENTION

Therefore, the object of the present invention is to provide a coated steel sheet suitable for production of DrD or DI cans, which sheet has very excellent formability and corrosion resistance, by applying several microns of coating paint containing ethylene-vinyl acetate copolymer on a cold rolled steel sheet which has been surface-treated in a very small degree (hereinafter called simply a cold rolled steel sheet).

According to the present invention, a solvent type thermo-setting paint containing ethylene-vinyl acetate copolymer is applied on the surface of the cold rolled steel sheet and the thus coated sheet is baked until the coating is completely cured.

The solvent type thermo-setting paint coating used in the present invention contains preferably 1 to 30%, more preferably 5 to 10%, by weight of ethylene-vinyl acetate copolymer on the basis of the solid substances of the paint, and is applied on the cold rolled steel sheet preferably in a thickness of 3 to 15 μm, more preferably 5 to 12 μm, in the dried state, and the ethylene-vinyl acetate copolymer contains preferably 5 to 40%, more preferably 5 to 15%, of vinyl acetate.

Further according to the present invention, the coating applied on the cold rolled steel sheet and remaining after DrD or DI forming is used as a base coating for subsequent coatings.

DETAILED DESCRIPTION OF THE INVENTION

The present invention will be described in details by referring to the DI (drawing and ironing) forming which has much severer forming conditions than those of the DrD forming.

Conventionally, as the DI cans which have been appearing in a large amount on the commercial market, aluminum cans and tin-plate cans which are coated after the working have been in practical use.

Contrary to the aluminum or tin-plate cans as conventionally known, the coated steel sheet for DI cans according to the present invention has technical features that a thermo-setting type of solvent coating in which 1–30% by weight of ethylene-vinyl acetate containing 5–40% by weight of vinyl acetate is added, for example epoxy-phenol, epoxy-urea, polyester, melamine, acrylic and vinyl coatings, is applied on the surface of a cold rolled steel sheet as cold rolled or as very slightly surface-treated in a thickness of 3 to 15 μm, and the coating is baked until the coating is completely cured, and the thus coated steel sheet is subjected to DI forming to obtain DI cans.

What are most important considerations in the present invention are:

(1) that the coating film is not damaged during the cup-drawing step;

(2) that the coating film after the ironing step is continuous; that is the pre-coated paint provides sufficient corrosion resistance even after DI forming, and (3) that a good stripping-out quality between the can and the ironing punch is assured after the ironing.

The present inventors have conducted various extensive studies and experiments for obtaining a coated steel sheet suitable for production of DI cans with full satisfaction to the above considerations from the aspect of a lubricant which maintains effective lubricity under severe reduction as in the ironing, and have found that the elongation and repellant elasticity of the lubricant have a great influence on the feasibility of DI forming of a paint-coated steel sheet, and found that a thermo-setting type of solvent paint in which ethylene-vinyl acetate copolymer is added is useful for the purpose.

Ethylene-vinyl acetate copolymer is high in softness and elasticity, and is blended with various polymers for improving impact resistance, formability and adhesion, and particularly the improvement of formability is remarkable with a small addition of ethylene-vinyl acetate copolymer.

However, with an excessive addition thereof will cause a problem in respect with the paintability because of increased viscosity. Therefore, 1 to 30% by weight of ethylene-vinyl acetate copolymer on the basis of the solid substances of the paint is preferred, and it is preferred that the paint containing ethylene-vinyl acetate copolymer is applied in a thickness of 3 to 15 μm in the dried state. With a coating film less than 3 μm, the desired results of the present invention can not be obtained, while on the other hand, with a coating film thickness exceeding 15 μm, a remarkable build-up appears during the subsequent forming step, thus causing various problems during the forming step.

The physical properties inherent to the ethylene-vinyl acetate copolymer are not lost and remain unchanged after the baking step of the paint into which it has been added, and there is caused no problem in respect with the formability even when the paint is baked until it gets into a completely cured state for full development of its inherent properties. Therefore, the paint according to the present invention has advantage that the properties of the paint coating are fully utilized after drawing and ironing.

As the lubricant used for pre-coated steel sheets for production of DI cans, it has been proposed to add wax such as esters of fatty acid to the paint (Tin International, Jan. 1977, pages 15–18; "Coated Black Plate, Steels Solvation in Beverage Cans"). However, according to this proposed method the coating is partially cured prior to drawing and ironing, because if the curing is performed completely the lubrication is provided only by the wax and thus enough lubricity required for drawing and ironing can not be achieved, thus failing to perform satisfactory drawing and ironing. However, the partial curing is often accompanied with various problems such as blocking during the coiling step and flavour after the packing.

As ethylene-vinyl acetate copolymer used in the present invention, almost all commercially available grades of ethylene-vinyl acetate copolymer can be used, and when it contains 5–40% of vinyl acetate drawing and ironing can be satisfactorily, and 60% or higher elongation can be obtained. The thermo-setting solvent paint in which ethylene-vinyl acetate copolymer having the above properties is dispersed is used as a precoating in the present invention and is selected depending on the final applications. For example, in case of food cans, where it is very often that a finishing paint coating is done after drawing and ironing, epoxy-phenol, epoxy-urea, melamine, acrylic and vinyl are commonly used, but the present invention should not be limited to the above particular paints.

The steel sheet coated with the solvent type thermo-setting paint in which ethylene-vinyl acetate copolymer is dispersed offers excellent corrosion resistance, namely continuity of the coating film after forming into DrD or DI cans.

Regarding the thickness of the paint coating to be pre-coated, with a thickness of 5 to 6 μm, completely no pinhole is observed on the DrD cans and only very slight occurrence of pinhole is observed on DI cans which are formed under more severe forming conditions. (The estimation of the pinhole occurrence is done by immersion in 20% $CuSO_4$ aqueous solution.)

In the above mentioned prior art in which the paint admixed with wax is partially cured before drawing and ironing, almost no paint coating remains on DI cans after drawing and ironing and precipitation of cupper is observed on the whole surfaces of the cans.

As compared with the DI cans obtained by the prior art, the cans produced from the steel sheet according to the present invention show excellent corrosion resistance due to the paint coating still remaining after the forming, and the paint coating thus remaining can be utilized as a base coating for the final finishing coating and can save the coatings on the cans which are usually performed twice after the forming, and thus only one finishing coating is sufficient.

Concludingly, the coated steel sheet for DrD or DI cans according to the present invention offers very excellent qualities completely unexpectable from the conventional art, particularly very excellent technical feasibility of drawing and ironing and very excellent corrosion resistance, namely continuity of the coating film even after the can forming, thus enabling to use the remaining coating film as a base coating after the forming.

DESCRIPTION OF PREFERRED EMBODIMENTS

The present invention will be better understood from the following examples.

EXAMPLE 1

50 mg/dm$^2$ of epoxy-phenol resin to which 10% ethylene-vinyl acetate copolymer containing 5% vinyl acetate was applied on a cold rolled steel sheet of 0.34 mm in thickness, baked at 205° C. of the steel sheet temperature for 10 minutes in a baking oven, and cooled to obtain a precoated steel sheet having a dried coating thickness of 5 μm. The precoated steel sheet thus obtained was drawn by a crank press into a cup of 86.90 mm diameter, and 35 mm height, and subjected to DI forming by a 5 ton hydraulic press under the following conditions.

The forming speed: 20 m/min.
The secondary drawing dice diameter: 66.10 mm
The primary ironing with 65.40 mm punch diameter and 350 mm stroke: 65.80 mm dia.
The secondary ironing with 65.40 mm punch diameter and 350 mm stroke: 65.64 mm dia.
The coolant: commercially available mineral oil The forming forces of the primary and secondary ironings and the strip-out force were respectively 2.7 tons, 2.6 tons and 0.8 ton, which represent a high degree of easiness of the ironing and the strip-out.

After the DI forming, an aqueous solution (10 g/l, 60° C., pH=9) of commercially available alkali degreasing agent was sprayed on the cans for 60 seconds to remove the coolant, washed and dried. During the degreasing step, the paint coating did not dissolve or peel off.

Then for estimation of the corrosion resistance (continuity of the coating film), the cans were immersed in 20% $CuSO_4$ aqueous solution (25° C.) for 30 seconds. The continuity of the coating film was good and occurrence of pinholes was very slight.

Whereas in case of a cold rolled steel sheet on which epoxy-phenol paint containing no ethylene-vinyl acetate copolymer was applied under the same conditions as above, the coating film was stripped off during the primary ironing and the cans were torn during the ironing so that the forming was not performed any further.

EXAMPLE 2

10 μm (dried) of epoxy-urea paint in which 20% ethylene-vinyl acetate copolymer containing 10% vinyl acetate was added, was applied on a cold rolled steel sheet, baked and subjected to DI forming under the same conditions as in Example 1.

The forming forces of the primary and secondary ironings and the strip-out force were respectively 2.6 tons, 2.3 tons and 0.6 ton, which indicate a high degree of easiness of the ironing and the strip-out.

After the forming, the cans were degreased in the same way as in Example 1 and corrosion tests were carried out for the coating film. During the degreasing step no dissolution and peel-off of the coating film was observed, and almost no occurrence of pinholes was observed.

Whereas in case of a cold rolled steel sheet on which epoxy urea paint containing no ethylene-vinyl acetate copolymer was applied under the same conditions, the cans were torn during the primary ironing so that the forming could not be performed any further.

EXAMPLE 3

5 μm (dried) of epoxy-phenol paint in which 20% ethylene-vinyl acetate copolymer containing 15% vinyl acetate was added was applied on a chromium-plated (0.001 μm) steel sheet of 0.34 mm in thickness and on a nickel-plated (0.001 μm) steel sheet, baked and subjected to DI forming under the same conditions as in Example 1. The forming forces for the primary and secondary ironings and the strip-out force were respectively 2.7 tons, 2.4 tons and 0.6 ton, which indicate a high level of easiness of the ironing and the strip-out.

After the forming step, the cans were degreased in the same way as in Example 1, and subjected to corrosion tests of the coating film. During the degreasing step, no dissolution and peel-off of the coating film was observed, and almost no occurrence of pinholes was observed.

Whereas in case of a chromium-plated or nickel-plated steel sheet on which epoxy-phenol paint containing no ethylene-vinyl acetate copolymer was applied under the same conditions as above, the cans were torn during the primary ironing so that the forming could not be performed any further.

EXAMPLE 4

5 μm (dried) of polyester paint in which 30% ethylene-vinyl acetate copolymer containing 30% vinyl acetate was added was applied on a cold rolled steel sheet, baked and subjected to DI forming under the same conditions as in Example 1.

The forming forces for the primary and secondary ironings and the strip-out force were respectively 2.9 tons, 2.6 tons and 0.8 ton, which indicate a high level of easiness of the ironing and the strip-out.

After the forming, cans were degreased in the same way as in Example 1 and subjected to corrosion tests of the coating film. During the degreasing step no dissolution and peel-off of the coating film was observed and occurrence of pinholes was very slight.

Whereas in case of a cold rolled steel sheet on which polyester containing no ethylene-vinyl acetate copolymer was applied in the same way as above, the cans were torn during the primary ironing so that the forming could not be performed any further.

EXAMPLE 5

Vinyl paint was applied on the inside surface of a DI can manufactured according to the procedures in Example 1, including DI forming, degreasing, washing and drying. For estimation of corrosion resistance, the can was cut into ¼ parts to obtain test pieces. The surface of the test piece was cut in a cross pattern by means of a diamond needle, while the edge and the back surface were sealed with a mixture of bees-wax and paraffin (1:1 by weight). Then the test piece was immersed in an aqueous solution of 1.5% citric acid and 1.5% sodium chloride into which carbonic acid gas had been blown for a whole day. The blowing of carbonic acid gas was continued during the test. After 96 hours of immersion, the test piece was taken out, rinsed with water, removed of water by compressed air, and the cross-cut portion was peel off by a cellophane tape. The measurement values thus obtained are called U.C.C. value. Meanwhile, the test piece without the cross-cut was immersed in the same aqueous solution for 15 days to measure the amount of iron dissolved from the test piece. The value thus obtained is called the iron pick-up value (I.P.V) ($\mu g/cm^2$). The results showed a U.C.C. value not more than 0.4 mm and an I.P.V. of 1 $\mu g/cm^2$.

Whereas when an electrolytic tin-plate (#50/50) was formed into cans, and vinyl paint was applied on the inside of the can, the U.C.C. value was 0.4 mm and the I.P.V. was 15 $\mu g/cm^2$. Thus equal or better corrosion resistance as compared with the conventional tin-plate DI cans could be obtained.

As clearly understood from the above examples, the coated steel sheet according to the present invention has very excellent qualities for production of DrD or DI cans.

What is claimed is:

1. A steel sheet for production of DrD or DI cans comprising a cold rolled steel sheet, a solvent type thermo-setting paint baked on the steel sheet in a completely cured state, said paint containing 1 to 30% ethylene-vinyl acetate copolymer on the basis of the solid substance of the paint and having a thickness of 3 to 15 μm in a dried state.

2. A steel sheet according to claim 1, in which the ethylene-vinyl acetate copolymer contains 5 to 40% vinyl acetate.

* * * * *